US007729915B2

(12) United States Patent
Balentine et al.

(10) Patent No.: US 7,729,915 B2
(45) Date of Patent: Jun. 1, 2010

(54) METHOD AND SYSTEM FOR USING SPATIAL METAPHOR TO ORGANIZE NATURAL LANGUAGE IN SPOKEN USER INTERFACES

(75) Inventors: Bruce Balentine, Denton, TX (US); Rex Stringham, Danville, CA (US); Justin Munroe, Denton, TX (US)

(73) Assignee: Enterprise Integration Group, Inc., San Ramon, CA (US)

( * ) Notice: Subject to any disclaimer, the term of this patent is extended or adjusted under 35 U.S.C. 154(b) by 925 days.

(21) Appl. No.: 10/459,739

(22) Filed: Jun. 12, 2003

(65) Prior Publication Data

US 2004/0037434 A1 Feb. 26, 2004

Related U.S. Application Data

(60) Provisional application No. 60/388,209, filed on Jun. 12, 2002.

(51) Int. Cl.
*G10L 21/00* (2006.01)

(52) U.S. Cl. ..... 704/270; 704/272; 704/275

(58) Field of Classification Search ..... 704/257, 704/260, 270, 275; 379/88.01, 88.02, 88.17–88.19; 463/35

See application file for complete search history.

(56) References Cited

U.S. PATENT DOCUMENTS 4,770,416 A * 9/1988 Shimizu et al. ..... 463/9
6,144,938 A * 11/2000 Surace et al. ..... 704/257
6,296,570 B1 * 10/2001 Miyamoto et al. ..... 463/30
6,385,581 B1 * 5/2002 Stephenson ..... 704/270
6,574,600 B1 * 6/2003 Fishman et al. ..... 704/270
6,606,374 B1 * 8/2003 Rokoff et al. ..... 379/88.16
6,683,938 B1 * 1/2004 Henderson ..... 379/67.1
6,697,460 B2 * 2/2004 Knott et al. ..... 379/88.22
6,760,050 B1 * 7/2004 Nakagawa ..... 715/848
2002/0094865 A1 * 7/2002 Araki et al. ..... 463/35
2002/0094866 A1 * 7/2002 Takeda et al. ..... 463/35
2002/0098886 A1 * 7/2002 Nishizawa et al. ..... 463/35
2003/0144055 A1 * 7/2003 Guo et al. ..... 463/35
2005/0256877 A1 * 11/2005 Searles et al. ..... 707/10

OTHER PUBLICATIONS

Maher, Brenden C.: "Navigating a Spatialized Speech Environment Through Simultaneous Listening within a Hallway Metaphor," Massachusetts Institute of Technology, Feb. 1998.*

* cited by examiner

*Primary Examiner*—Richemond Dorvil
*Assistant Examiner*—Douglas C Godbold
(74) *Attorney, Agent, or Firm*—Alston & Bird LLP

(57) ABSTRACT

A method and an apparatus for providing audio information to a user. The method and apparatus provide information in a manner consistent with a spatial metaphor, allowing a user to visualize and more easily navigate an application. The information is preferably presented to the user as a background audio prompt that indicates the environment and a foreground audio prompt that indicates the alternatives available to the user.

19 Claims, 5 Drawing Sheets

METHOD AND SYSTEM FOR USING SPATIAL METAPHOR TO ORGANIZE NATURAL LANGUAGE IN SPOKEN USER INTERFACES

This Application claims the benefit of the filing date of U.S. Provisional Application No. 60/388,209, filed Jun. 12, 2002, and entitled "METHOD AND SYSTEM FOR USING A SPATIAL METAPHOR TO ORGANIZE NATURAL LANGUAGE IN SPOKEN USER INTERFACES".

TECHNICAL FIELD

The invention relates generally to voice recognition systems and, more particularly, to a method and an apparatus for providing comments and/or instructions in a voice interface.

BACKGROUND

Voice response systems, such as brokerage interactive voice response (IVR) systems, flight IVR systems, accounting systems, announcements, and the like, generally provide users with information. Furthermore, many voice response systems, particularly IVR systems, also allow users to enter data via an input device, such as a microphone, telephone keypad, keyboard, or the like.

The information/instructions that voice response systems provide are generally in the form of one or more menus, and each menu may comprise one or more menu items. The menus, however, can become long and monotonous, making it difficult for the user to identify and remember the relevant information.

Therefore, there is a need to provide audio information to a user in a manner that enhances the ability of the user to identify and remember the relevant information that may assist the user.

SUMMARY

The present invention provides a method and an apparatus for providing audio information to a user by presenting a background prompt that indicates an environment and a foreground prompt that indicates available options.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

In the following discussion, numerous specific details are set forth to provide a thorough understanding of the present invention. However, it will be obvious to those skilled in the art that the present invention may be practiced without such specific details. In other instances, well-known elements have been illustrated in schematic or block diagram form in order not to obscure the present invention in unnecessary detail. Additionally, for the most part, details concerning telecommunications and the like have been omitted inasmuch as such details are not considered necessary to obtain a complete understanding of the present invention, and are considered to be within the skills of persons of ordinary skill in the relevant art.

It is further noted that, unless indicated otherwise, all functions described herein may be performed in either hardware or software, or some combination thereof. In a preferred embodiment, however, the functions are performed by a processor such as a computer or an electronic data processor in accordance with code such as computer program code, software, and/or integrated circuits that are coded to perform such functions, unless indicated otherwise.

Figure 1:
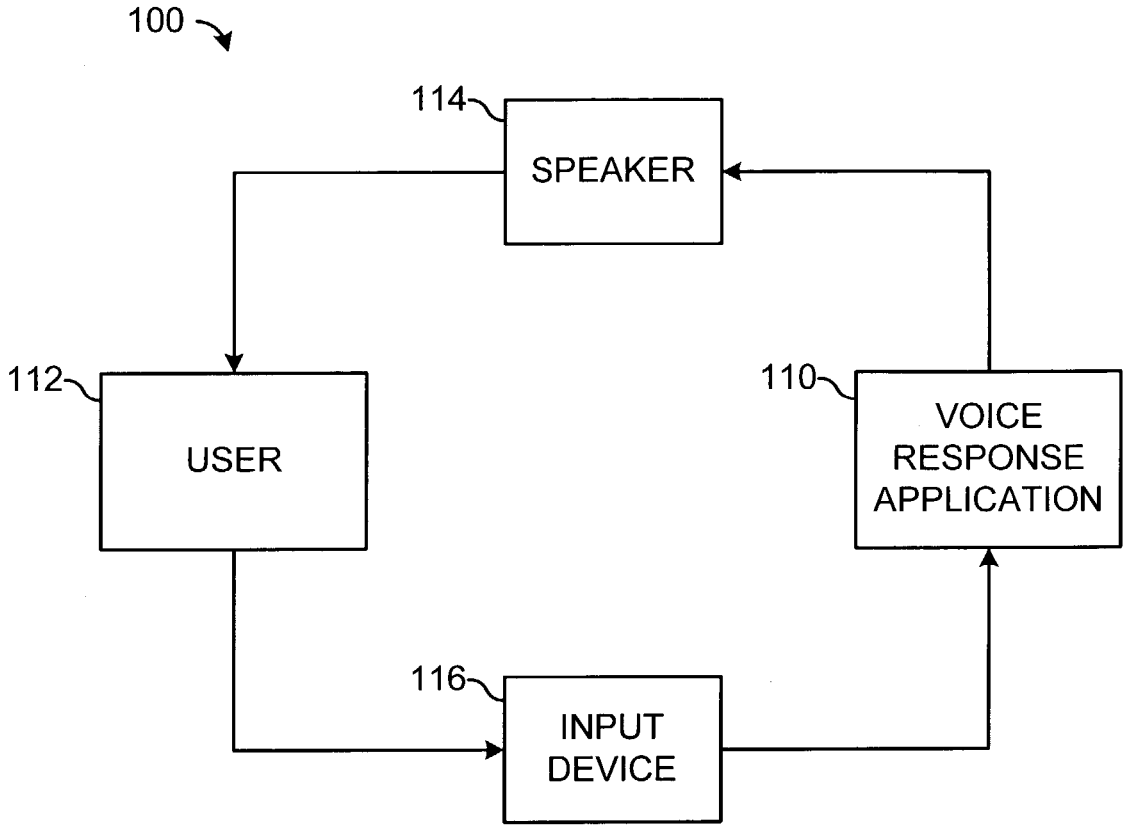
FIG. 1 schematically depicts a typical network environment that embodies the present invention.

Referring to FIG. 1 of the drawings, the reference numeral 100 generally designates a voice response system embodying features of the present invention. The voice response system 100 is exemplified herein as an interactive voice response (IVR) system that may be implemented in a telecommunications environment, though it is understood that other types of environments and/or applications may constitute the voice response system 100 as well, and that the voice response system 100 is not limited to being in a telecommunications environment and may, for example, include environments such as microphones attached to personal computers, voice portals, speech-enhanced services such as voice mail, personal assistant applications, and the like, speech interfaces with devices such as home appliances, communications devices, office equipment, vehicles, and the like, other applications/environments that utilize voice as a means for providing information, such as information provided over loudspeakers in public places, and the like.

The voice response system 100 generally comprises a voice response application 110 connected to one or more speakers 114, and configured to provide audio information via the one or more speakers 114 to one or more users, collectively referred to as the user 112. Optionally, an input device 116, such as a microphone, telephone handset, keyboard, telephone keypad, or the like, is connected to the voice response application 110 and is configured to allow the user 112 to enter alpha-numeric information, such as Dual-Tone Multi-Frequency (DTMF), ASCII representations from a keyboard, or the like, and/or audio information, such as voice commands.

In accordance with the present invention, the user 112 receives audio information from the voice response application 110 via the one or more speakers 114. The audio information may comprise information regarding directions or location of different areas in public locations, such as an airport, a bus terminal, sporting events, or the like, instructions regarding how to accomplish a task, such as receiving account balances, performing a transaction, or some other IVR-type of application, or the like. Other types of applications, particularly IVR-type applications, allow the user 112 to enter information via the input device 116.

The present invention is discussed in further detail below with reference to FIGS. 2-4 in the context of a banking IVR system. The banking IVR system is used for exemplary purposes only and should not limit the present invention in any manner. Additionally, the figures and the discussion that follows incorporate common features, such as barge-in, the use of DTMF and/or voice recognition, and the like, the details of which have been omitted so as not to obscure the present invention. Furthermore, details concerning call flows, voice recognition, error conditions, barge-in, and the like, have been largely omitted and will be obvious to one of ordinary skill in the art upon a reading of the present disclosure.

Figure 2:
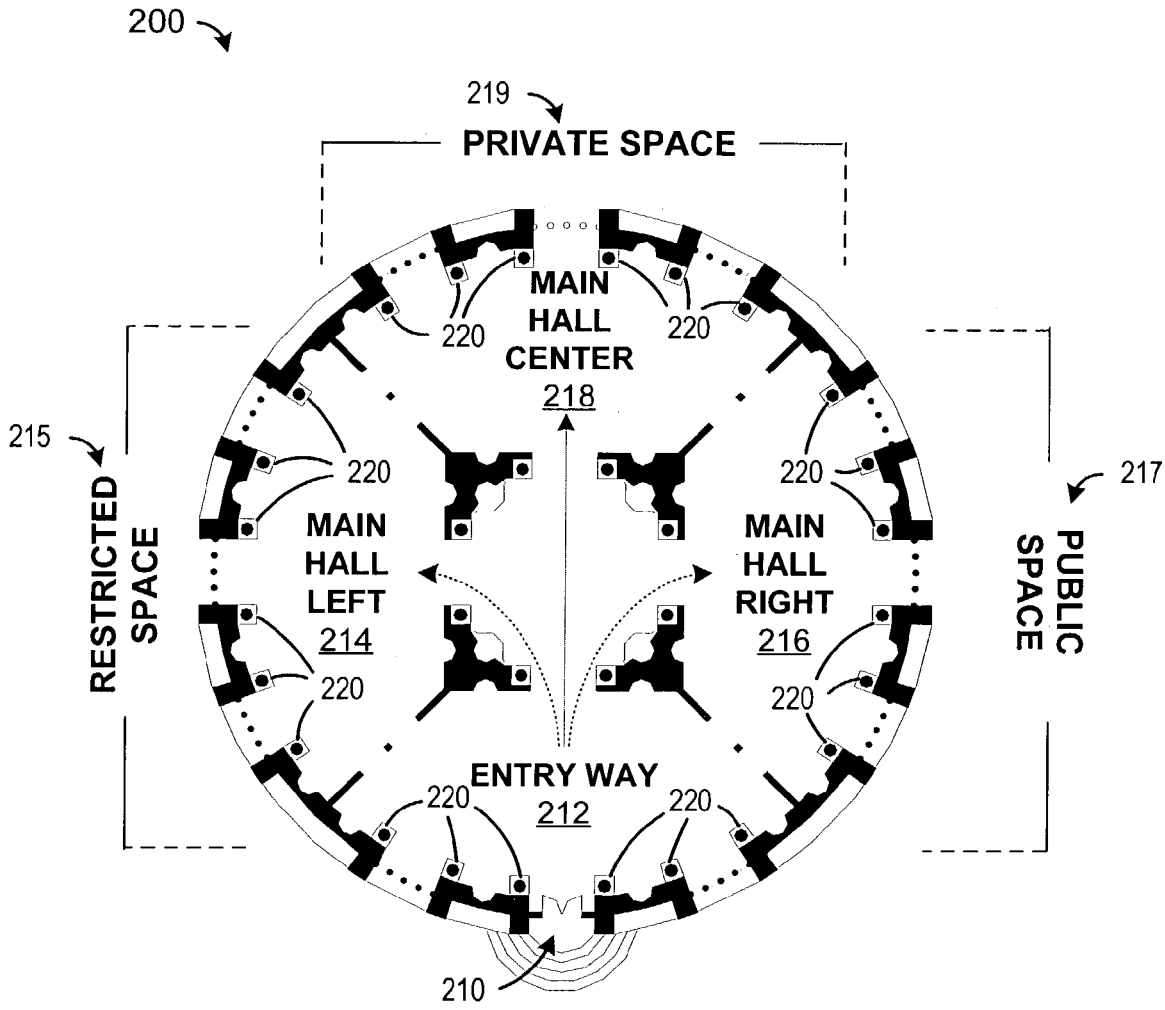
FIG. 2 graphically illustrates an environment of one embodiment of the present invention in which a spatial metaphor is used to present audio information to a user.

FIG. 2 is a visual representation of one embodiment of the present invention in which the user is presented with audio information regarding available options and/or alternatives. Specifically, a great hall 200 is depicted as a rotunda with an doorway 210 and four large areas, an entry way 212, a main hall left 214, a main hall right 216, and a main hall center 218. Each area 212, 214, 216, and 218 comprises one or more smaller areas 220, such as an office, a kiosk, or the like. It should be noted, however, that the use of a rotunda is for exemplary purposes only and should not limit the present invention in any manner. Other configurations, such as a rectangular hall or the like, may be used as well.

Each area 212, 214, 216, and 218 preferably represents various areas within an application. For example, in a banking IVR system, the main hall right 216 may represent a "public space" 217 to which all users have access, providing functions such as opening a new account, time and temperature, certificate of deposit interest rates, and the like. The main hall left 212 may represent a "restricted space" 215 to which all member users, i.e., users who subscribe to the service, have access, providing functions such as stock quotes, initiating a transaction, and the like. The main hall center 218 may represent a "private space" 219, i.e., a user-customizable area, to which only a specific user may gain access, providing functions such as portfolio tracking, account balances, or the like.

In accordance with the present invention, the great hall 200 provides a spatial metaphor to allow the user 112 to visualize the services available within the application. Preferably, as will be described in further detail below with reference to FIGS. 3-4, the user is presented with audio that corresponds to movement through the great hall 200. For example, the user 112 may be presented with audio representing doors opening and/or closing, background voices uttering indiscernible words (referred to as "hubbub" audio), voices of nearby customers, the voice of a tour guide, and/or the like. The audio may change as the user 112 moves from one area into another area, and the grammars and prompts change that imply that the user 112 is traveling past the small areas 220. When the user 112 enters a particular command, such as by voice, DTMF, or the like, the audio reflects that the user 112 has entered a private office or kiosk to "make the deal."

Figure 3:
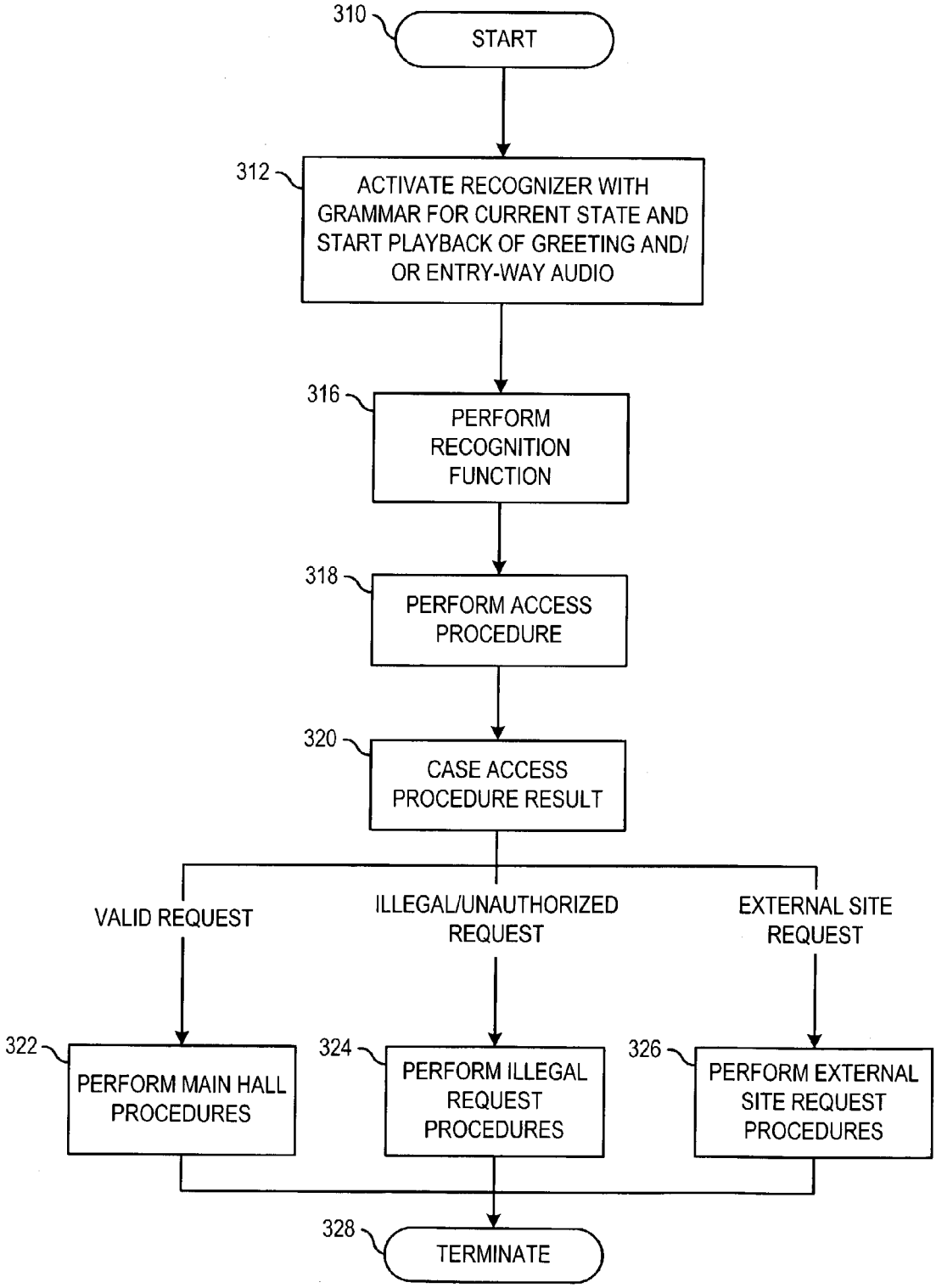
FIG. 3 is a data flow diagram illustrating one embodiment of the present invention in which information is presented to a user via a spatial metaphor.

FIG. 3 is a flow chart depicting steps that may be performed by the voice response application 110 in accordance with one embodiment of the present invention that provides audio corresponding to a spatial metaphor, such as the great hall 200 discussed above with reference to FIG. 2.

Processing begins in step 310, wherein the voice response application 110 is initiated. Processing proceeds to step 312, wherein the voice recognizer is activated with a grammar corresponding to the current location of the user, i.e., the entry way 212 (FIG. 2), and a prompt is started playing. Preferably, the voice recognizer is activated prior to initiating the playing of prompts to allow a user to enter a command prior to the completion of a prompt, a feature commonly referred to as barge-in. Additionally, as is well known in the art, a grammar comprises phrases and commands that are valid at any particular location in the voice response application 110, and may include phrases and commands that allow a user to skip or jump to other areas of the voice response application 110, such as the natural language interface described in U.S. Provisional Patent Application No. 60/250,412, filed on Nov. 30, 2000, entitled User Interface Design by Bruce Balentine, et al., which is assigned to the assignee of this application and is incorporated herein by reference for all purposes.

After activating the voice recognizer, a greeting and/or an entry way audio prompt is initiated. The greeting audio prompt is preferably a short, distinctive prompt welcoming the user to the application, such as, "Welcome to the Great Hall." Additionally, to maintain the illusion of a Great Hall, the greeting audio prompt may comprise of an opening sound, such as the audio of opening gates, a flourish of trumpets, or the like, that precedes, is mixed with, or follows the welcoming prompt. The use and sound of a greeting audio prompt is optional, but, if used, is preferably less than five seconds.

Also initiated in step 312 after the greeting audio prompt is the entry way prompt. The entry way prompt is a prompt that corresponds to the entry way 212 (FIG. 2). For example, the entry way prompt may comprise, "You're at The Entry Way. Would you like get some information, perform a transaction, or go on to the Central Hall?", "Great Hall Entry Way. You're facing the Central Hall. Say go ahead, go left, or go right.", or the like.

After the greeting and/or entry way audio prompts are initiated, processing proceeds to step 316, wherein the recognition function is performed. The voice recognition function may be implemented with any voice recognition algorithm, such as the Hidden-Markov Model (HMM), n-gram and statistical language modeling approaches, or the like, and is well known in the art and will not be described in further detail. Additionally, the voice recognition function preferably accepts as input user speech, DTMF, and/or the like, and generates as output a recognized command. While the present invention is disclosed in the context of voice recognition, it is conceived that the present invention may be used with an application that accepts as input speech and DTMF, only DTMF, or the like. The use of the present invention with an application that accepts other types of input will be obvious to a person of ordinary skill in the art upon a reading of the present invention. It should also be noted that error conditions, such as mis-recognitions, invalid commands, no input detected, and the like, have been omitted in order to simplify and more clearly disclose the present invention.

After generating a recognized command in step 316, processing preferably proceeds to step 318, wherein the access procedure is performed. Optionally, as described above, the voice response application 110 may contain areas in which user access is restricted, such as the private space 219 (FIG. 2) or restricted space 215 (FIG. 2). In step 318, the voice response application 110 verifies that the user may perform the requested activity. The verification process may be performed, for example, by comparing the Automatic Number Identification (ANI) with an ANI stored in a database associated to the user. Other methods, such as using a Personal Identification Number (PIN), and the like, may be used.

After, in step 318, the access procedure is performed, processing proceeds to step 320, wherein the access procedure result is analyzed and the appropriate steps taken. The access procedure preferably generates a result that indicates whether the user request is valid (the user is authorized to perform the requested function), whether the user request is illegal, or whether the user requested an external site. If, in step 320, it is determined that the access procedure result indicates the user requested and is authorized to perform a valid function, then processing proceeds to step 322, wherein the user is granted access to one or more areas 220 of the great hall 200, the processing of which is described in further detail below with reference to FIG. 4.

If, in step 320, it is determined that the user requested an illegal function and/or is not authorized to perform the requested function, then processing proceeds to step 324, wherein the illegal request procedures are performed. Preferably, if the user requested an illegal function and/or is not authorized to perform the requested function, then an appropriate prompt is played to the user and an appropriate action is taken. The prompt played and the action taken is dependent, upon other things, the type of application, the request made, and the like, and will be obvious to one skilled in the art upon a reading of the present disclosure.

Optionally, if in step 320, it is determined that the user requested an external site, then processing proceeds to step 326, wherein the voice response application 110 may allow a link to an external web site, information source, or utility application by saying an application-specific phrase or entering a unique DTMF sequence.

Upon completing the processing in steps 322, 324, and/or 326, processing proceeds to step 328, wherein processing terminates.

Figure 4:
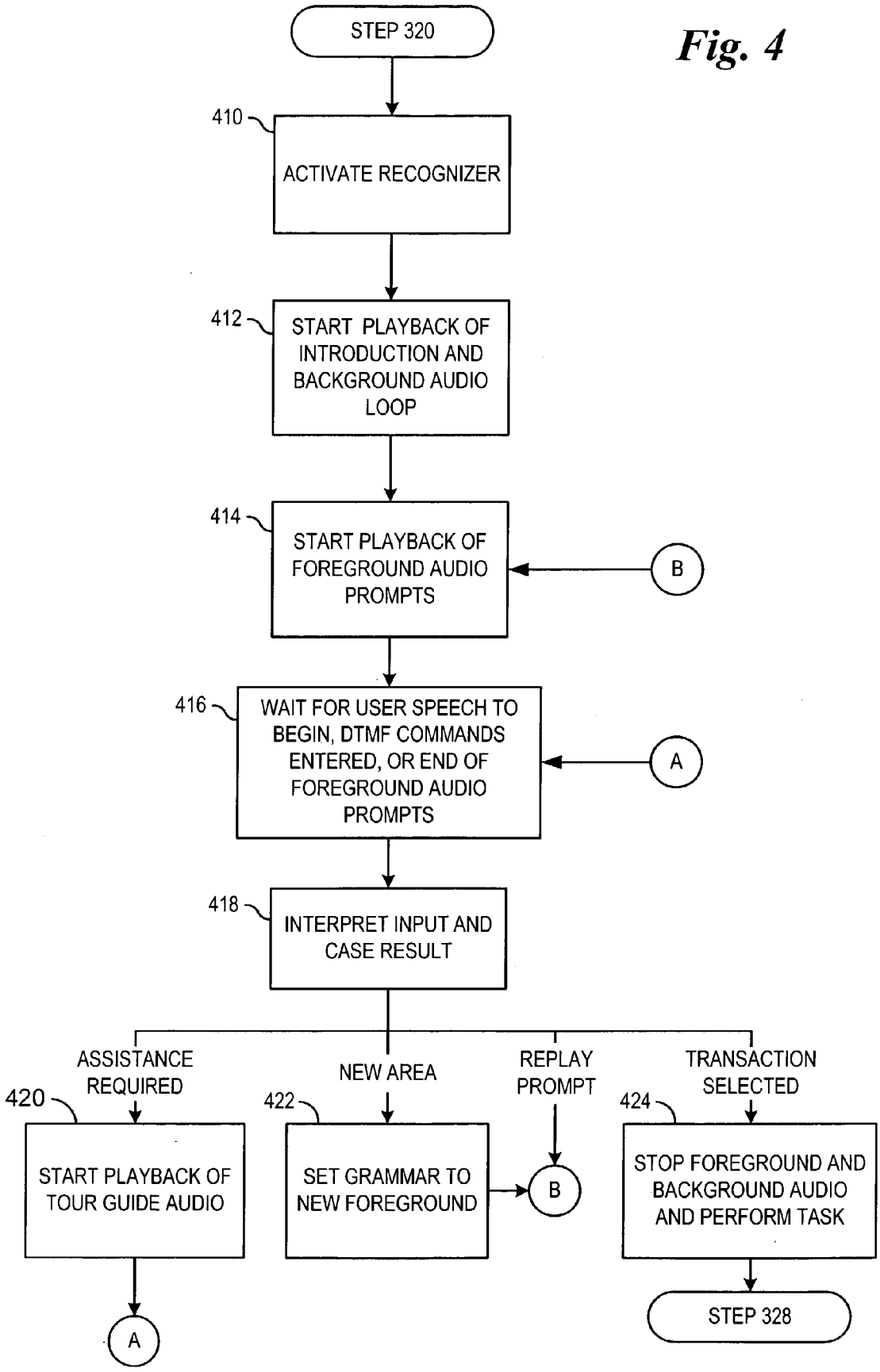
FIG. 4 is a data flow diagram illustrating one embodiment of the present invention in which background and foreground audio information is presented to a user.

FIG. 4 is a flow chart depicting steps that may be performed in the main hall, discussed above with respect to step 322 (FIG. 3), in accordance with a preferred embodiment of the present invention. Accordingly, if a determination is made in step 320 (FIG. 3) that the user has entered a valid command and/or is authorized to perform that command, then processing proceeds to step 322 (FIG. 3), the details of which are depicted by steps 410-424 of FIG. 4.

Processing begins in step 410, wherein the voice recognizer is activated, preferably with a large grammar that encompasses global behaviors as well as those capabilities appropriate to the user location within the Great Hall. Thereafter, in step 412, an introductory transition and background audio prompt is initiated. The introductory transition audio prompt informs the user of the available areas, and is preferably accompanied by sounds that help maintain the illusion of a Great Hall, or other such area. For example, sample introductory transition audio prompts include:

"The information hall is to your right <sound of door opening>;"

"For transactions, please enter to your left <sound of door opening>;"

"Straight ahead for your personal business <sound of door opening>;"

"The left hall is for e-commerce <sound of door opening>;" and

"Welcome to the Center Hall <sound of door opening>."

In the above examples, the "<sound of the door opening>" helps maintain the illusion of standing in an entry way with multiple doors leading to different sections.

In addition to the introductory transition audio prompt, it is preferred that a background audio prompt be played. The background audio prompt is preferably the sound of a hall full of people, i.e., the sound of many people talking simultaneously, whose words are indistinguishable, and is faded-in and faded-out as doors are opened and closed, respectively. Furthermore, the background audio prompt may change dependent on the area in which the user is currently navigating to further aid in maintaining the illusion that the user is moving from one area to another. For example, the tone, volume, density, and the like may vary based upon the area in which the user is currently navigating.

The background audio prompt is preferably played continuously while the user is navigating around the Great Hall, and until the user selects a specific transaction to perform. The background audio prompt may be implemented by any means available to achieve the effects described above, including methods such as recording another prompt on top of the background audio prompt, using digital mixing equipment, and the like.

After initiating the background audio prompt, and after playing the introductory transition prompt, prosecution proceeds to step 414, wherein the foreground audio prompt is initiated. It should be noted that the foreground audio prompt is preferably played over or on top of the background audio prompt, and is preferably presented as the voice of another customer speaking a valid request, i.e., presented as if the user is overhearing other customers performing transactions. To further maintain the illusion, it is preferred that the various options are presented in differing voices and/or tone, loudness, pace, or the like, to simulate the overhearing of other customers, some of which are nearer than others, performing valid transactions. For example, foreground audio prompts for a particular location may include:

(female voice #1): "How's the weather in Ft. Lauderdale?";

(male voice #1): "What's the forecast for Denver?";

(female voice #2): "Tell me today's headlines."; and (male voice #2): "I want the horoscope for Gemini."

After initiating the foreground audio prompt in step 414, processing proceeds to step 416, wherein the voice response application 110 waits for user speech to be detected, a DTMF command to be entered, or the end of the foreground audio prompts. Upon the occurrence of one or more of these events, processing proceeds to step 418, wherein the event, and any input, such as a DTMF or voice command, is interpreted and a result generated. The generation of the results is dependent upon internal algorithms, but preferably is grouped into one of three possible results. First, if the voice response application 110 has no reason to assume there is any need to change states, then processing returns to step 414, wherein the foreground prompt is replayed, or, optionally, an alternative foreground prompt that restates the same alternatives in a slightly different manner is played.

Second, if the voice response application 110 determines that the user requires assistance, then processing proceeds to step 420, wherein a tour guide prompt is played. The tour guide prompt provides helpful hints on how to proceed and/or to receive assistance, and is preferably presented as a single character throughout the voice response application 110. For example, sample prompts that may be played as the tour guide prompt include:

"Just repeat anything you hear. If you wait, you'll overhear more examples.";

"Just say 'go ahead' to move through the hall.";

"Feel free to speak whenever you hear something you might want."; and

"Here are some users like yourself . . . let's listen in."

Specific events that particularly indicate that a tour guide prompt may be helpful include no speech from the user for a certain amount of time, garbage recognitions in excess of a predetermined threshold, and inter-word rejections from the n-best list on single-token utterances. Thereafter, processing returns to step 414.

Third, if the voice response application 110 determines that the user is traveling through the Great Hall, i.e., moving from one area to another, then processing proceeds to step 422, wherein the grammar is set to correspond to the new area. As discussed above, the foreground prompts are representative examples of transactions that the user may request and are presented as a user may overhear other customers in the immediate area. Therefore, as the user moves from one area to another, the examples, i.e., the foreground prompt, change accordingly. Thereafter, processing returns to step 414, wherein the foreground prompts are played that correspond to the new area.

Fourth, if the voice response application 110 determines that the user has selected a transaction to perform, then processing proceeds to step 424, wherein the foreground and background audio prompts are halted and the task is performed. Preferably, the illusion at this point in the dialog is that the user has been escorted into a private office in which the transaction will occur. The transaction may involve additional prompts and/or user input (via speech or DTMF), but is preferably performed without the playing of the background audio prompt. Upon completion of the transaction, processing returns to step 328 (FIG. 2), or, alternatively, the voice response application 110 may allow the user to perform another transaction. The process of allowing the user to perform another transaction is considered well known to a person of ordinary skill in the art and, therefore, will not be disclosed in further detail.

Figure 5:
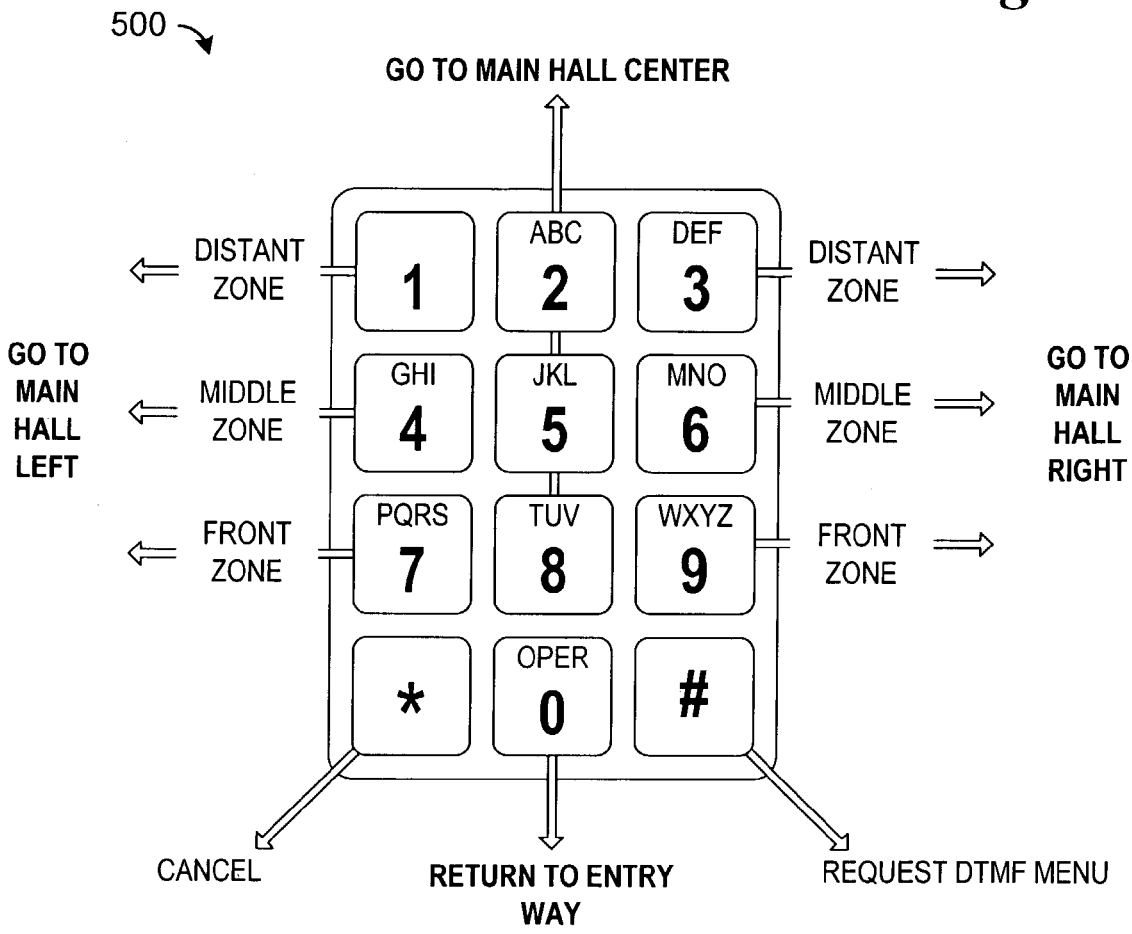
FIG. 5 graphically illustrates one embodiment of the present invention in which a keypad interface is provided for navigating a spatial metaphor.

FIG. 5 is a visual representation of a keypad interface, such as a telephone keypad 500, that may be used to navigate the spatial metaphor represented as great hall 200 (FIG. 2) using Dual-Tone Multi-Frequency (DTMF) audio signals such as commonly used in touch-tone telephone systems. Users may request keypad versions of activities in lieu of voice commands at any time. Access to keypad activities is an important feature for security, privacy, or other reasons. Pressing keys on the keypad 500 activates DTMF input, in lieu of user speech, in circumstances in which the user might not want to be overheard speaking.

For fast keypad operation, FIG. 5 shows shortcuts for moving from one area to another wherein a logical relationship exists between the keys and movement in the great hall. The example shown is one of several ways a designer might specify keypad shortcuts for accessing different services within an application. The keys of the keypad 500 may be analogous to various locations within the spatial metaphor, or to a user's position and desired direction of movement. As illustrated in the following example, the location to which a shortcut leads is a function of the location of the key depressed in relation to other keys on the keypad 500 and an analogous location in the great hall.

To navigate the embodiment shown in FIG. 2, the keys of keypad 500 in the embodiment shown in FIG. 5 are analogous to a location in the great hall. The user 112 can press keypad key 8 to go to the main hall center area 218 (FIG. 2), or press keypad key 7 to go to the main hall left area 214 (FIG. 2), or press keypad key 9 to go to the main hall right area 216 (FIG. 2). The user can then press keypad key 0 to return to the entry way area 212 (FIG. 2). Each area 214, 216, and 218 may comprise different zones within the area, such as a front zone, a middle zone, and a distant zone, each zone representing, for example, specific services and/or options available within the application for which the spatial metaphor is provided.

To navigate quickly to a desired zone within an area, the user 112 can press one of a group of keypad keys to designate the desired zone within the desired area. For example, the user 112 can press keypad key 7 to go to a front zone of the main hall left area 214, or press keypad key 4 to go to a middle zone of area 214, or press keypad key 1 to go to a distant zone of area 214. Similarly, the user 112 can press keypad key 8 to go to a front zone of the main hall center area 218, or press keypad key 5 to go to a middle zone of area 218, or press keypad key 2 to go to a distant zone3 of area 218. Likewise, the user 112 can press keypad key 9 to go to a front zone of the main hall right area 216, or press keypad key 6 to go to a middle zone of area 216, or press keypad key 3 to go to a distant zone of area 216.

Control functions can also be available through the keypad interface. The user 112 may request a menu of keypad activities available by pressing the keypad "pound" [#] key. The user 112 can press the keypad "star" [*] key to cancel an activity.

It is understood that the present invention can take many forms and embodiments. Accordingly, several variations may be made in the foregoing without departing from the spirit or the scope of the invention. For example, one will note that the above-disclosed processing encompasses and can be combined with error correcting, looping to allow multiple transactions, and the like. These variations are considered well known to a person of ordinary skill in the art upon a reading of the present invention. Therefore, the examples given and the omission of these variations should not limit the present invention in any manner.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. A method of providing audio information to a user of an interactive response system, the method comprising the steps of:

presenting a background prompt by the interactive response system to the user indicating to the user an environment;

presenting one or more foreground prompts by the interactive response system indicating to the user a selection means for entering at least one of one or more available commands, the at least one of the one or more available commands indicated being variable according to a location of the user in the environment; and altering the background prompt by the interactive response system to the user in response to a user entered command to the interactive response system by the user selected from the one of the one or more available commands indicated to the user, to reflect perceived movement of the user within the environment wherein the one or more foreground prompts provided by the interactive response system to the user further comprises spoken exemplars of the one or more available commands.

2. The method of claim 1, wherein the environment comprises at least one of a rotunda, a hall, and an open market.

3. The method of claim 1, wherein the background prompt comprises audio representative of people talking.

4. The method of claim 1, wherein the foreground prompt further comprises alternative commands available for user entry and sounds representative of one or more of movement within the environment and action within the environment.

5. The method of claim 1, wherein each of the one or more foreground prompts vary in terms of one or more of tone, volume, pace, speaker, and pitch.

6. A method of providing audio information to a user of an interactive response system providing audio prompts inviting user responses to the prompts, the method comprising the steps of:

presenting a background prompt by the interactive response system to the user indicating to the user an environment;

presenting concurrently with the background prompt a foreground prompt by the interactive response system indicating to the user one or more available commands, the at least one of the one or more available commands indicated being variable according to a location of the user in the environment; and altering the background prompt by the interactive response system to the user in response to a user entered command, to reflect perceived movement of the user within the environment wherein the foreground prompt comprises audio of spoken exemplars of the performance of the one or more available commands.

7. The method of claim 6, wherein the environment comprises at least one of a rotunda, a hall, and an open market.

8. The method of claim 6, wherein the background prompt comprises audio representative of people talking.

9. The method of claim 6, wherein the foreground prompt comprises alternative commands available to the user and sounds representative of one or more of movement within the environment and action within the environment.

10. The method of claim 6, wherein each of the one or more foreground prompts vary in terms of one or more of tone, volume, pace, speaker, and pitch.

11. A method of interfacing to a user of an interactive response system to perform a transaction, the method comprising the steps of:

playing background audio by the interactive response system to the user that corresponds to a representation of at least one of a location of the user, background noise, and movement of the user within an environment to the user;

presenting foreground audio by the interactive response system to the user comprising spoken exemplars of selection of transactions using one or more available commands, wherein the user can select a transaction by using said one or more available commands, the one or more available commands indicated in the spoken exemplars being dependent upon the location of the user within the environment;

receiving at the interactive response system a command from the user;

determining in the interactive response system whether the command represents movement within the environment or a selection of a transaction to perform;

upon a determination that the command represents movement within the environment, modifying the foreground audio and the background audio by the interactive response system to reflect the movement within the environment; and upon a determination by the interactive response system that the command is an available command at the location of the user in the environment and represents the selection of a transaction to perform, performing the transaction.

12. The method of claim 11, wherein the location comprises at least one of a rotunda, a hall, and an open market.

13. The method of claim 11, wherein the background prompt comprises audio representative of people talking.

14. The method of claim 11, wherein the foreground prompt comprises alternative commands available to the user and sounds representative of one or more of movement within the environment and action within the area.

15. The method of claim 11, wherein each of the one or more foreground prompts vary in terms of one or more of tone, volume, pace, speaker, and pitch.

16. A method of providing audio information to a user about available response options in an interactive response system providing audio prompts inviting user responses to the prompts, the method comprising the steps of:

presenting a background prompt by the interactive response system indicating to the user one of at least a first environment and a second environment, each of the first and second environments having a different set of available response options associated therewith for selection by the user, the first and second environments being audibly distinguishable from one another;

presenting by the interactive response system a first or second set of one or more foreground prompts audibly distinguishable from the first mode, each set corresponding to one of the first and second environments, the foreground prompts comprising spoken exemplars of the performance of available response options suggesting to the user an available command; and altering the background prompt by the interactive response system in response to receiving from the user the available command , to reflect perceived movement of the user within the environment.

17. The method of claim 16, wherein the first environment simulates hubbub heard in a public space and the second environment has a lower volume of hubbub simulating a quieter area of the public space and wherein the foreground prompts comprise distinguishable voices simulating other users making selections of the available command in the second environment.

18. The method of claim 16, wherein the first environment includes audio hubbub of a public space and the second environment simulates the audio environment of a room adjacent to the public space and separated by a closed door.

19. The method of claim 16, wherein the first environment includes audio hubbub of a public space and the second environment simulates the audio environment of a room adjacent to the public space but not separated by a door.

* * * * *